US007150120B1

(12) United States Patent
Naymik

(10) Patent No.: US 7,150,120 B1
(45) Date of Patent: Dec. 19, 2006

(54) VEHICLE PERMIT HOLDER

(76) Inventor: George M Naymik, 822 Cinnamon Dr. East, Winter Haven, FL (US) 33880

( * ) Notice: Subject to any disclaimer, the term of this patent is extended or adjusted under 35 U.S.C. 154(b) by 0 days.

(21) Appl. No.: 11/236,117

(22) Filed: Sep. 26, 2005

Related U.S. Application Data

(60) Provisional application No. 60/613,127, filed on Sep. 26, 2004.

(51) Int. Cl.
*G09F 21/04* (2006.01)

(52) U.S. Cl. ..... 40/643; 40/654.01; 40/660; 40/661

(58) Field of Classification Search ..... 40/643, 40/644, 654.01, 660, 661, 661.05
See application file for complete search history.

(56) References Cited

U.S. PATENT DOCUMENTS 1,645,229 A * 10/1927 Churmusi ..... 40/653
4,171,584 A * 10/1979 Kaiser ..... 40/490
4,240,543 A * 12/1980 McKee ..... 206/39
D303,403 S * 9/1989 Barcom ..... D20/43
D313,820 S * 1/1991 Wright ..... D19/90
D418,171 S * 12/1999 Robinson et al. ..... D20/42
6,347,471 B1 * 2/2002 Mirza ..... 40/661
6,367,182 B1 * 4/2002 Olson, Jr. ..... 40/593
6,708,435 B1 * 3/2004 Massey ..... 40/643
2003/0079392 A1 * 5/2003 Newman ..... 40/661
2004/0000080 A1 * 1/2004 Massey ..... 40/599
2004/0016162 A1 * 1/2004 Rendon ..... 40/654.01
2004/0221498 A1 * 11/2004 Vico et al. ..... 40/593

* cited by examiner

*Primary Examiner*—Gary C. Hoge
(74) *Attorney, Agent, or Firm*—Kenneth L Tolar

(57) ABSTRACT

A vehicle permit display device includes a substantially hollow, wide profile envelope formed of a transparent material. The envelope includes an opening on a side edge thereof for receiving a vehicle permit. A hook extends from an upper edge of the envelope for securing to a vehicle rearview mirror mounting post. Alternatively, the device may be fastened to a vehicle window using suction cups or other similar means.

2 Claims, 1 Drawing Sheet

VEHICLE PERMIT HOLDER

CROSS REFERENCE TO RELATED APPLICATIONS

This application is entitled to the benefit of provisional application No. 60/613,127 filed on Sep. 26, 2004.

BACKGROUND OF THE INVENTION

The present invention relates to a case for conveniently displaying handicap parking permits.

DESCRIPTION OF THE PRIOR ART

Handicap parking permits are required in order to park a vehicle in certain handicap designated parking spaces; the permits are typically elongated having a hook portion at an upper end for securing the permit to a rearview mirror mounting post. However, the dangling card obstructs the driver's view and is often removed whenever the driver is operating the vehicle. Accordingly, a user can easily forget to reattach the card resulting in a parking citation. The present invention addresses this problem by providing a uniquely designed device for securing and displaying such parking permits.

SUMMARY OF THE INVENTION

The present invention relates to a permit display device for a vehicle comprising a transparent, wide-profile envelope formed of plastic or a similar durable, lightweight material. The envelope includes a front surface, a rear surface, two opposing side edges, a lower edge and an upper edge. Extending from the upper edge is a hook for reception of a rear view mirror mounting post. A side edge includes an opening in communication with a hollow interior for slidable reception of a vehicle permit. Accordingly, the pertinent vehicle permit is slid into the envelope and the envelope is mounted on the rear view mirror so that the permit is readily visible to passersby.

It is therefore an object of the present invention to provide a vehicle permit display case for displaying a vehicle permit in an unobtrusive fashion.

It is another object of the present invention to provide a vehicle permit display case that allows a user to quickly and easily display a permit.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
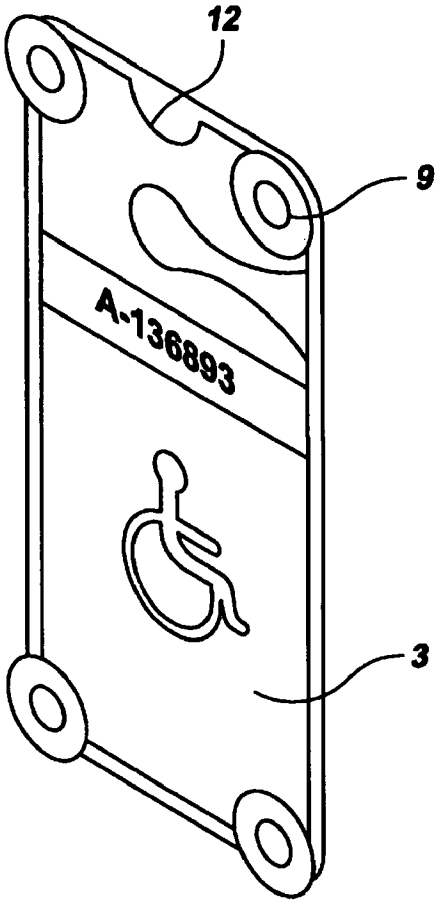
FIG. 2 is a perspective view of a second embodiment of the present invention.
Figure 1:
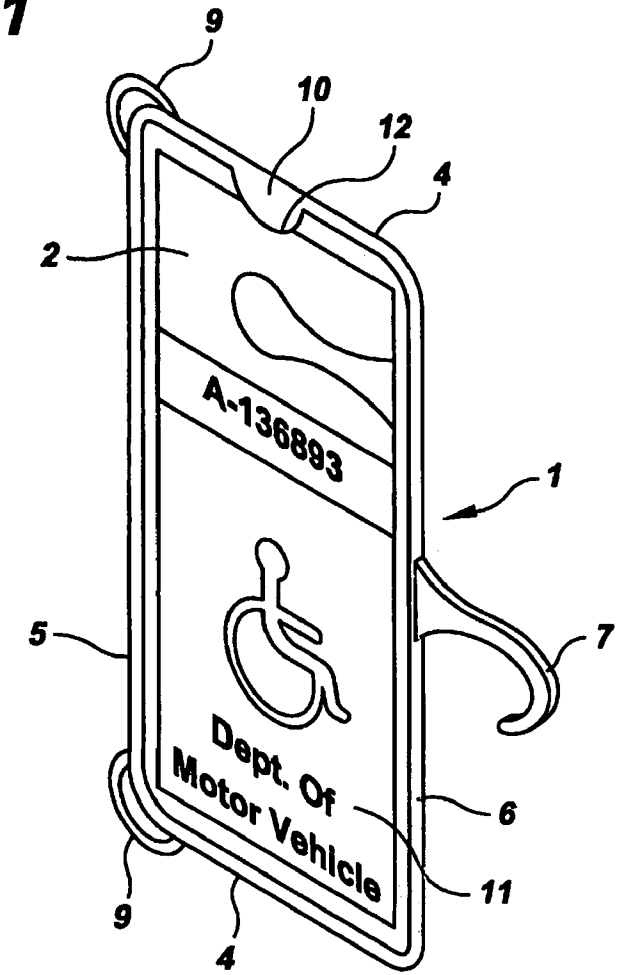
FIG. 1 is a perspective view of a first embodiment of the present invention.

The present invention relates to a permit display device for a vehicle comprising a transparent, wide-profile envelope 1 formed of plastic or a similar durable, lightweight material. The envelope includes a front surface 2, a rear surface 3, two opposing side edges 4, a lower edge 5 and an upper edge 6.

Extending from the upper edge is a hook member 7 for securing the envelope to a rear view mirror mounting post. Adjacent the lower edge of the envelope are a pair of suction cups 9, each preferably positioned proximal a corner. The suction cups further anchor the envelope to the vehicle's windshield, preventing it from flailing when suspended from the rearview mirror. As depicted in FIG. 2, the hook can be omitted and the envelope could instead include one or more additional suction cups proximal the upper edge. Accordingly, the envelope could be mounted on a surface where a rearview mirror is unavailable such as the rear windshield.

A side edge includes an opening 10 in communication with a hollow interior for slidably receiving a vehicle permit 11. The opening preferably includes a finger indention 12 to assist a user in inserting and removing the permit. Accordingly, the pertinent vehicle permit is slid into the envelope and the hook is fastened to the rearview mirror mounting post. The wide profile envelope will be suspended horizontally so as not to substantially interfere with a driver's view while conspicuously displaying the permit to passersby.

The above described device is not limited to the exact details of construction and enumeration of parts provided herein. Furthermore, the size, shape, materials of construction and type of fastener means for securing the envelope can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A permit display device for a vehicle comprising:

a transparent, wide-profile envelope having a front surface, a rear surface, a first side edge, a second side edge, a lower edge and an upper edge;

a hook member extending from the upper edge for securing the envelope to a rearview mirror mounting post;

an opening on the first side edge of said envelope, said opening in communication with a hollow interior for slidably receiving a vehicle permit;

at least one suction cup adjacent the lower edge of the envelope for further anchoring the envelope to the vehicle's windshield, preventing it from flailing when suspended from a rearview mirror mounting post.

2. The permit display device according to claim 1 wherein said opening includes a finger indention to assist a user in inserting and removing a permit.

* * * * *